United States Patent [19]

Stephenson

[11] Patent Number: 4,481,934

[45] Date of Patent: Nov. 13, 1984

[54] FRICTION FURNACE

[76] Inventor: Douglas D. Stephenson, Site #3, Box 29, R.R. #1, Regina, Saskatchewan, Canada, S4P 2Z1

[21] Appl. No.: 463,148

[22] Filed: Feb. 2, 1983

[30] Foreign Application Priority Data

Feb. 4, 1982 [GB] United Kingdom ..... 8203183

[51] Int. Cl.[3] ..... F24C 9/00

[52] U.S. Cl. ..... 126/247; 122/26; 237/12.1; 165/67

[58] Field of Search ..... 126/247; 122/26; 165/8, 165/67, 69; 62/295; 237/12.1

[56] References Cited

U.S. PATENT DOCUMENTS

| | | | |
|---|---|---|---|
| 3,164,147 | 1/1965 | Love et al. | 126/247 |
| 4,143,639 | 3/1979 | Frenette | 126/247 |
| 4,271,790 | 6/1981 | Ahmed et al. | 122/26 |
| 4,273,075 | 6/1981 | Freihage | 122/26 |
| 4,312,322 | 1/1982 | Freihage | 126/247 |
| 4,343,291 | 8/1982 | Clausen | 126/247 |
| 4,357,931 | 11/1982 | Wolpert et al. | 126/247 |
| 4,365,614 | 12/1982 | Grover | 126/247 |
| 4,424,797 | 1/1984 | Perkins | 126/247 |

*Primary Examiner*—Margaret A. Focarino
*Attorney, Agent, or Firm*—Stanley G. Ade

[57] ABSTRACT

A horizontally located stationary drum supports a horizontally located rotor drum concentrically therewithin defining a relatively small annular space therebetween with a heat transfer fluid in said annular space. The rotor drum is rotated by a source of power thus generating frictional heat which is picked up by an air stream in a furnace type construction. In a further embodiment, the rotor drum is situated between an inner stationary drum and an outer stationary drum with annular spaces between the rotor and each of the stationary drums and with heat transfer fluid situated in each annular space thus increasing the heat generating capacity of the device.

15 Claims, 10 Drawing Figures

FRICTION FURNACE

BACKGROUND OF THE INVENTION

This invention relates to new and useful improvements in friction furnaces. Friction furnaces are those in which a source of power is used to rotate an inner drum within a stationary outer drum with a relatively small annular clearance between the two drums. The inner drum is usually provided with a roughened surface and oil is provided in the base of the drums which normally stand vertically, to generate the friction heat as the inner drum rotates. As the inner drum rotates, the oil in the base of the stationary drum, moves upwardly to partially fill the annular space and heat is extracted from the outer drum by various means including air passed over the outer drum, it being understood that heat transmission is by conduction and convection.

Such vertical drum friction furnaces take considerable time for the inner drum to get up to its full speed due to oil drag and even under optimum conditions, the oil appears to rise only approximately one-third of the space between the two drums so that the vertically situated friction drum is relatively inefficient.

SUMMARY OF THE INVENTION

The present invention overcomes disadvantages inherent with conventional vertically situated friction furnaces by providing an interior rotor journalled for rotation within a stationary exterior drum, said drums being mounted horizontally with the inner drum being rotated by any convenient source of power.

This means that a relatively small amount of oil can be provided between the two drums which normally collects in the bottom of the stationary drum. When the inner drum is rotated, pick-up speed is rapid as the oil readily circulates around the horizontally located annular space between the two drums. By providing an overflow assembly, the entire annular space may be filled with oil so that heat transfer is far more efficient. The power required to rotate the inner drum is also less than with a corresponding vertical assembly and servicing and maintenance are considerably less than with conventional friction type furnaces.

One aspect of the invention is to provide a heat generating device comprising in combination a supporting structure, a fixed horizontally located drum supported in said supporting structure, a horizontally located rotor drum concentrically journalled for rotation within said fixed drum, a source of power for rotating said rotor drum, a concentrically located annular space defined between said fixed drum and said rotor drum, means journalling said rotor drum for rotation within said fixed drum and a heat transfer fluid situated between said drums.

Another advantage of the present invention is that the drive from the source of power is relatively straight forward and, if desired, a second drum assembly is easily mounted upon the first drum assembly and rotated thereby, by means of pulleys and double belts or chains and sprockets, as desired.

Another advantage of the present invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
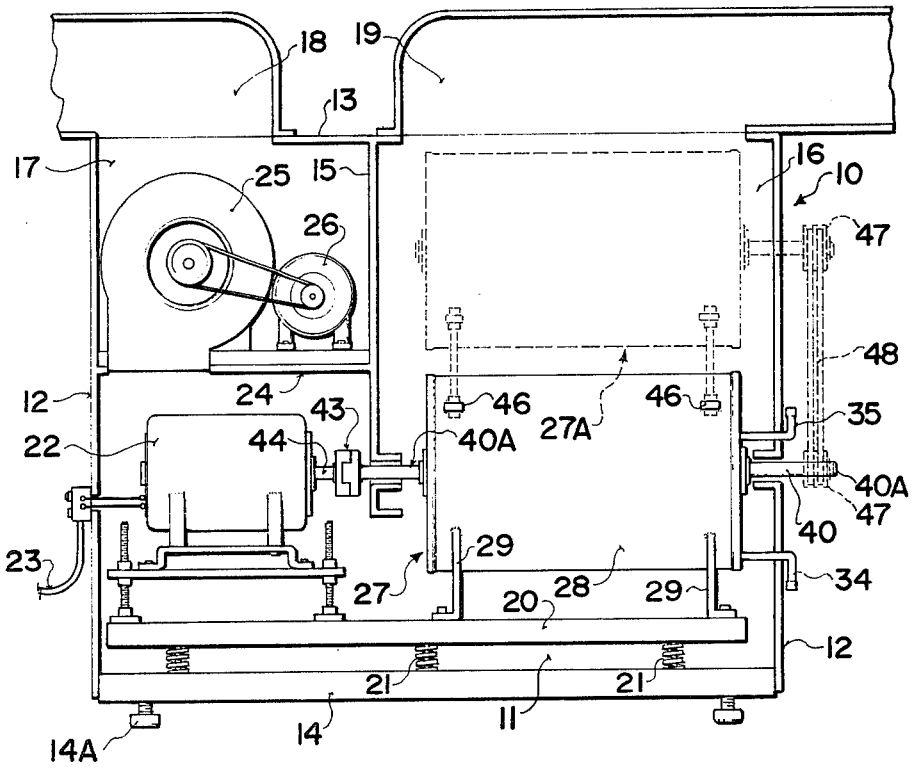
FIG. 1 is a vertical section of the enclosure showing the invention mounted therein.
Figure 2:
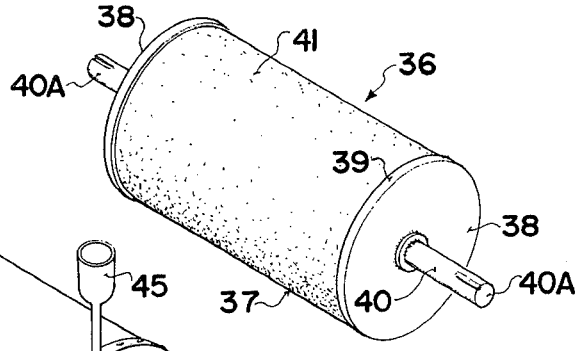
FIG. 2 is an isometric view of the rotor per se.
Figure 3:
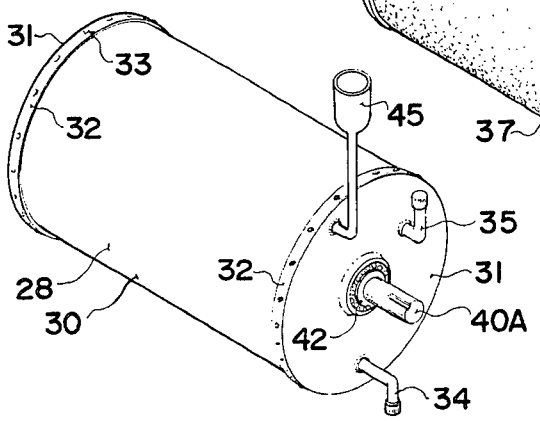
FIG. 3 is an isometric view of the stationary drum per se.

Proceeding therefore to describe the invention in detail, reference character 10 illustrates a substantially box-like casing including spaced and parallel sides 11, spaced and parallel ends 12 and upper side 13 and a base 14 with suitable bracing being provided (not illustrated).

The interior of this casing is preferably insulated (not illustrated) and is supported upon adjustable feet 14A which are conventional in construction.

A vertically situated divider 15 divides the casing or enclosure into a hot air plenum 16 and a cold air plenum 17. The cold air plenum includes a cold air duct connector 18 which may be connected to the cold air return system. The hot air plenum includes the duct extension 19 which may be connected to the hot air system of a heating system.

Situated within the base of the enclosure is a support platform 20 supported upon resilient mounts 21 which are conventional and this support plate extends under the low edge of the partition 15 and into both plenums. Within the cold air plenum a source of power such as an electric motor 22 is provided and supported upon the platform in a conventional manner with a power cord 23 extending through the wall of the casing for connection to a source of electrical energy.

A further support platform 24 spans the cold air plenum above the motor 22 and supports a fan 25 driven by motor 26 adapted to draw air downwardly through the cold air return duct opening 18 and to force same under the partition 15 upwardly through the hot air plenum 16 and through the duct connector 19.

Situated within the hot air plenum and supported upon the support platform 20 is the friction furnace component collectively designated 27. It includes a cylindrical outer drum 28 mounted within a cradle 29 which in turn is supported by the platform 20. The cylindrical drum preferably includes the cylindrical body portion 30 with a pair of end caps 31 secured one upon each end thereof. The end caps are preferably provided with a flanged lip 32 either engaging over the ends of the body 30 or internally thereof and being secured by means of screws 33 and sealed by conventional sealant so that the stationary drum assembly is a sealed unit.

A drain plug or tap 34 is situated within one end cap 31 and an oil filler plug 35 is also provided.

Journalled for rotation within the drum is the cylindrical rotor element collectively designated 36. This consists of a cylindrical body portion 37 having end plates 38 secured to each end thereof as by welding or the like. These end plates or caps may also be provided with an annular flange 39 engaging over or within the ends of the body portion 37.

A mounting shaft or spindle 40 extends axially through the drum 36 and through the end plates or caps 38 and is secured thereto as by welding or the like with the ends extending beyond the end plates as clearly shown. The outer surface of the drum body 37 may be roughened or sandblasted as at 41 to provide friction as the rotor is rotated as will hereinafter be described.

A seal and bearing assembly 42 is detachably secured within axially situated apertures in the end caps 31 of the stationary drum 28 and these seals and bearings support the rotor within the drum by means of the shaft or spindle portions 40 extending through the seals and bearings, the extensions being indicated by reference character 40A.

When journalled for rotation within the stationary drum, there is a relatively small annular clearance between the outer surface of the rotor and the inner surface of the drum. A quantity of oil or other heat transfer fluid 67 (see FIG. 6) is situated within the base of the drum when the rotor is stationary, said oil being introduced through the aforementioned filler plug 35.

A conventional drive connection 43 extends between the motor shaft 44 and the one end 40A of the rotor shaft 40 and this drive extends through the partition 15.

When the motor is actuated, the rotor is rotated within the drum and almost immediately, the oil within the base of the drum is picked up by the roughened surface of the rotor and extends around the annular space between the drum and the rotor with the frictional shear action of the roughened surface causing heat to be generated, said heat passing through the drum wall to the outer surface thereof to be picked up by the air passing thereby due to fan 25.

An oil reservoir or overflow assembly 45 extends from one end of the drum upwardly thereabove similar in operation to the coolant overflow assembly normally used on conventional automobile engines and this ensures that any expansion due to heat generation, vents excess oil to the reservoir 45 which is then returned to the drum upon cooling.

This ensures that the annular space is always substantially full of oil thus giving a much more efficient operation than the conventional vertical friction furnace. This assembly 45, together with drum plug 34 and filler 35, may be extended through the wall 11, if desired, for convenience.

If desired, a further stationary drum and rotor assembly 27A may be mounted above the first assembly 27 by means of mounts 46 and may be driven by pulleys or sprockets 47 situated on the ends 40A of the shafts and connected by means of belts or chains 48 so that the two rotors are driven concurrently. These shafts also may extend through wall 11 with the belts and pulleys, etc. being situated externally and, of course, suitably shielded.

Figure 4:
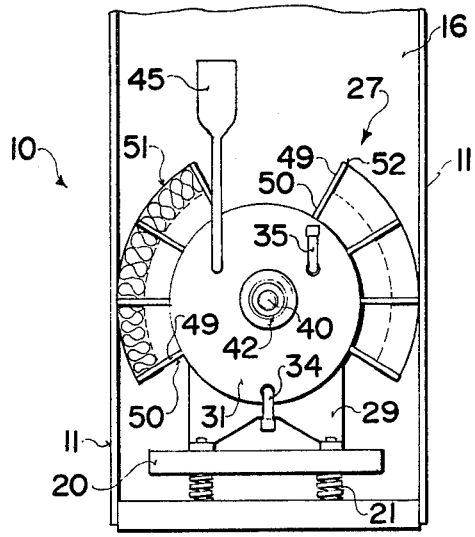
FIG. 4 is an end view of the drum assembly.
Figure 5:
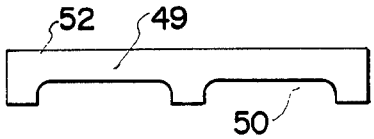
FIG. 5 is a front elevation of one of the air guiding baffles.

FIG. 4 shows schematically a plurality of baffles 49 which may extend radially from the drum wall 30 of the stationary drum and which are apertured on the underside as at 50 in FIG. 5 so that air can be routed closely around the surface of the drum. This requires a shield 51 or the equivalent extending partly around the outer edges 52 of the baffles with entry and exit areas for the air.

Advantage of the device over conventional frictional furnaces include little or no lathe work required, ease of maintenance and service and ease of construction and use of relatively standard parts which are easily available.

There is no requirement for hydraulic pumps or hoses and the device is not restricted to size inasmuch as one, two, three or more units may be connected together depending upon the area to be heated.

The device is self-contained and eliminates any requirement for fuel, chimney, flames, pilot lights and the like.

Furthermore, it shows a considerable improvement over existing vertically situated friction furnaces taking less power and generating more heat.

Figure 7:
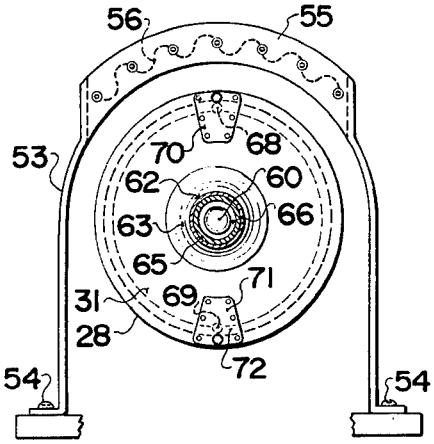
FIG. 7 is a schematic end view of the stationary drum together with a schematic view of an electrical element.
Figure 9:
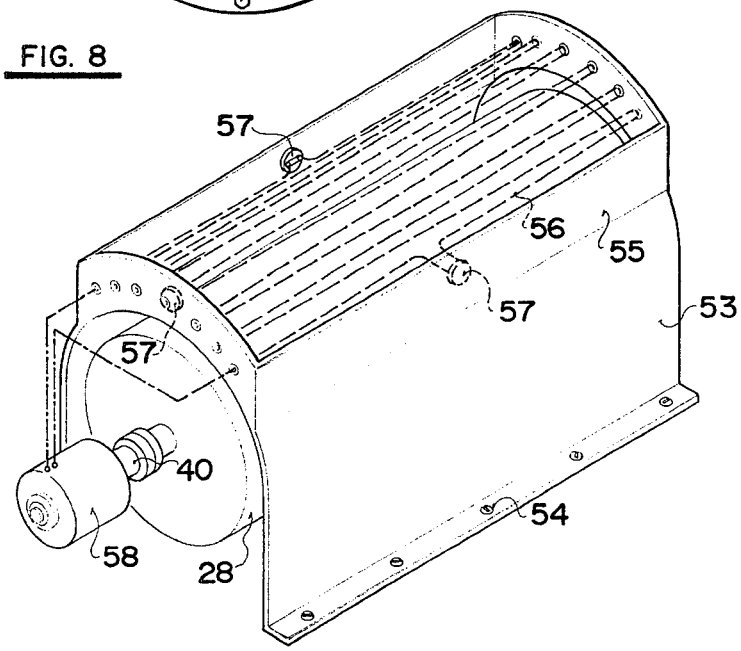
FIG. 9 is a schematic isometric view of FIG. 7.

Dealing next with the embodiment illustrated in FIGS. 7 and 9, a support drum or shroud 53 extends around the stationary drum 28 and is spaced therefrom and secured to the base 20 by means of screws 54.

An arcuately curved element holder 55 is secured to the upper portion of the shroud 53 and carries electrical elements or coils 56 as shown, with thermostatically controlled discs 57 being incorporated to protect from overheating. These electrical elements may either be connected directly to line voltage either 110 or 230, or may be energized by means of an alternator or generator 58 operatively connected to the drive shaft 40 extending from the rotor 36 through the ends of the stationary drum 28. It will be appreciated that a larger motor 22 may be required under these circumstances.

The air stream generated by fan 25, not only passes over the stationary drum but also between the shroud and the drum and over the electrical elements 56 which may be of different capacity for different size buildings.

A separate or dual thermostat set at a lower temperature may control the electrical coils when extreme cold is encountered or if problems arise with the friction furnace.

Otherwise, the elements help pre-heat the drum and, if desired, domestic hot water can be heated by the electrical elements and stored in a hot water jacket (not illustrated).

The elements are easily changed or serviced by removing an end service panel of the cabinet 10 (not illustrated).

Figure 6:
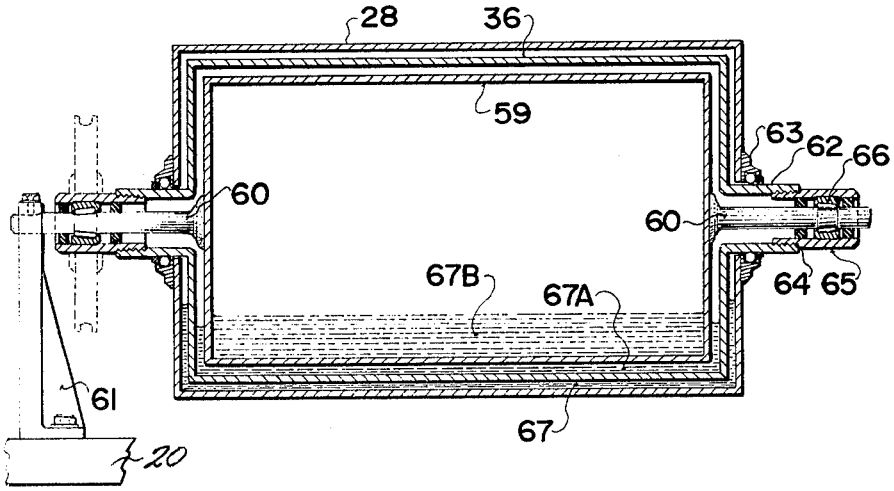
FIG. 6 is a schematic cross sectional view of an alternative embodiment of the drum structure.
Figure 8:
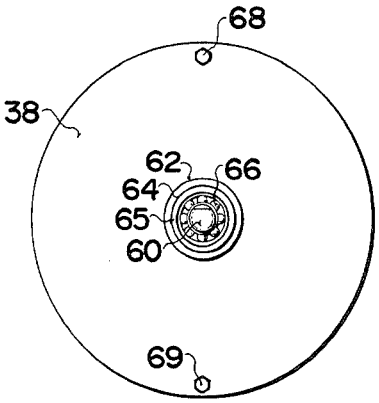
FIG. 8 is an end view of the rotor used in FIG. 6.

A still further embodiment is shown schematically in FIG. 6 and partially in FIGS. 7 and 8.

In this embodiment, there is a further stationary drum 59 situated within the rotor 36. The spacing between the periphery of the stationary drum 59 and the interior of the rotor drum 36 is similar to the spacing between the outer surface of the rotor and the inner surface of the first stationary drum or casing 28.

FIG. 6 shows one method of mounting the drums with the stationary drum 59 having stub shafts 60 extending axially from each end thereof, through the ends of casing 28 to be supported upon base 20 by means of a cradle 29 (not illustrated in this view) similar to the previous embodiment. A stop member 61 extends from the base 20 and clamps to the stub shaft 60 at one end to prevent rotation of this inner drum 59. The rotor 36 is provided with hollow stub shafts or cylinders 62 extending axially from the ends thereof and being supported within bearings 63 in the walls or end caps of the stationary outer drum 28. Threaded pipe joints 64 connect hollow bearing shafts 65 to the portions 62 and are in turn supported for rotation upon bearings 66 on stationary stub shafts 60.

A quantity of oil or other heat transfer fluid 67A is situated between the stationary drum 59 and the interior of the rotor 36 and operates in a manner similar to the oil or other transfer fluid 67 which is present between the outer surface of the rotor and the outer stationary drum or casing 28. Once again the outer surface of the stationary drum 59 may be roughened or sandblasted to increase the frictional resistance as the rotor rotates. A further quantity of heat transfer fluid or the like or other heat transfer product 67B may be situated within the stationary drum 59, all of which adds to the transfer of heat generated by the friction from the rotation of the rotor 36.

The rotor 36 is rotated by the source of power 22 causing the fluid or the like 67 and 67A to heat up rapidly and transfer heat to the surfaces of the drums.

The source of power should turn the rotor in a direction so that the threaded pipe joints 64 do not unscrew during rotation.

It will also be appreciated that a sufficiently large motor 22 must be provided with this embodiment.

FIG. 8 shows the end view of the rotor which includes a filler plug 68 and a drain plug 69 in the end cap 38 and situated diametrically opposite one another. Not shown are corresponding plugs at the other end of the rotor or drum to help balance same during rotation.

The outer drum or casing 28 is provided with an upper removable plate 70 in one end 31 thereof for access to the filler plug 68 on the rotor and a further removable plate 71 is provided adjacent the base of the end cap 31 which, when removed, enables the fluid to be drained from the center of the rotor. This plate 71 is provided with a plug 72 in order to remove fluid from the outside of the rotor.

It will be appreciated that this rotor 36 being situated between two stationary drums, can use fluid or other heat transfer liquid on both sides thereof rather than just on the outer side as in the previous embodiment. This will approximately double the frictional surface available for heat generation.

Figure 10:
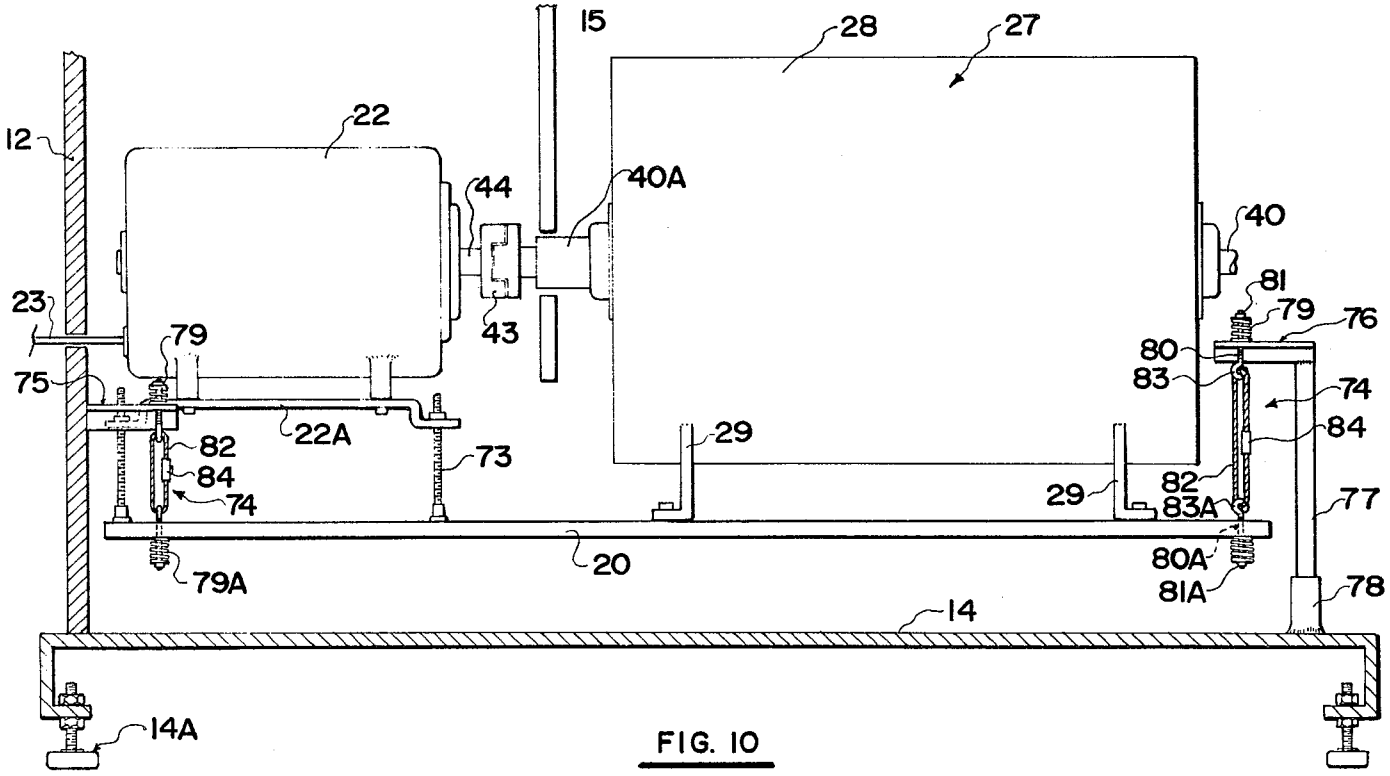
FIG. 10 is a partially schematic side elevation showing the preferred suspension system of the drum and motor components.

FIG. 10 shows the preferred method of supporting the drum assembly 27 and the motor component 22 in order to reduce or eliminate vibration from the drum and motor which normally would be transferred to the base and the cabinet.

The drum assembly 27 is supported in cradles 29 upon the base 20 as hereinbefore described with the motor 22 being supported upon the sub-plate 22A which in turn is also supported upon the base 20 by means of nut and bolt assemblies 73, it being understood that there are four such assemblies 73 and that cradles 29 extend to the other side of the drum 27.

The entire assembly upon base 20 is suspended upon four spring assemblies collectively designated 74, two of which only are shown in FIG. 10. The two assemblies 74 supporting the motor end of the base are in turn supported from angle iron brackets 75 extending inwardly from the side 12 of the casing and the spring assemblies 74 at the other end are supported within horizontal components 76 which in turn are secured to vertical members 77 socketed into sockets 78 which in turn extend upwardly from the base 14 of the cabinet. These supports 76 and 77 can be disengaged from the vertically situated sockets 78 and removed, so that the drum assembly 27 can be moved outwardly of the cabinet for repair and/or replacement.

Each spring assembly 74 includes an upper compression spring 79 spot welded or otherwise secured by the lower end thereof to the brackets 75 or horizontal members 76 and an I-bolt 80 extends freely through the brackets 75 and 76, and through the springs 79 and is held in position by means of nuts 81 screw threadably engaging the upper ends of the I-bolts 80.

Similar compression springs 79A are secured by the upper ends thereof as by spot welding, to the underside of the base 20 and I-bolts 80A extend freely through the base and through the springs 79A and are secured by means of nuts 81A to the screw threaded ends of the I-bolts 80A.

A loop of flexible cable 82 extends through the eyes 83 of the I-bolts and these cables are tightened to lift the base 20 together with the drum 27 and motor assembly 22, to the desired height whereupon the cable loops are clamped by means of cable clamps 84. The weight of the assembly compresses the springs 79 and 79A and these springs are further compressed to the desired amount thus pre-loading same, by means of the cable loops 82.

This type of suspension not only reduces or eliminates vibration, but the cable loops absorb any torque, twisting and/or shaking caused by the motor and rotor rotating.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A heat generating device comprising in combination a supporting structure, a fixed drum with its axis horizontally supported in said supporting structure, a horizontally located rotor drum, means mounting said rotor drum for rotation within said fixed drum coaxially, relative thereto so as to define, a coaxially located annular space between said fixed drum and said rotor drum, means for introducing a viscous fluid between said drums to develop heat from the relative rotation, and an electric resistance heating element mounted adjacent to said stationary drum and operatively connected to a source of electrical energy to provide supplementary heat to said device.

2. The device according to claim 1 which includes baffle means associated with said fixed horizontal drum to guide air around said fixed drum to pick up heat therefrom.

3. The device according to claim 1 which includes a surrounding casing and means to mount said device within said casing, said last mentioned means including a base plate, said device being secured to said base plate and means to mount said base plate resiliently within said casing.

4. The device according to claim 2 which includes a surrounding casing and means to mount said device within said casing, said last mentioned means including a base plate, said device being secured to said base plate and means to mount said base plate resiliently within said casing.

5. The device according to claim 3 in which said surrounding casing includes a divider defining a cold air plenum and a hot air plenum, said device being situated within said hot air plenum.

6. The device according to claim 1 in which the electric resistance heating element is thermostatically controlled.

7. The device according to claim 1 which includes a further stationary drum concentrically mounted within said rotor drum and spaced therefrom to define an annular space therebetween and a heat transfer fluid situated within said last mentioned annular space.

8. The device according to claim 3 which includes a further stationary drum concentrically mounted within said rotor drum and spaced therefrom to define an annular space therebetween and a heat transfer fluid situated within said last mentioned annular space.

9. The device acccording to claim 5 which includes a further stationary drum concentrically mounted within said rotor drum and spaced therefrom to define an annular space therebetween and a heat transfer fluid situated within said last mentioned annular space.

10. The device according to claim 3 in which said means to mount said base plate resiliently within said casing includes also, means to mount said source of power upon said base plate, support means from said base plate on said supporting structure, first spring means on said supports, second spring means on said base plate and flexible links operatively suspending said base plate between said first and second spring means.

11. The device according to claim 5 in which said means to mount said base plate resiliently within said casing includes also, means to mount said source of power upon said base plate, support means from said base plate on said supporting structure, first spring means on said supports, second spring means on said base plate and flexible links operatively suspending said base plate between said first and second spring means.

12. The device according to claim 4 in which said means to mount said base plate resiliently within said casing includes also, means to mount said source of power upon said base plate, support means from said base plate on said supporting structure, first spring means on said supports, second spring means on said base plate and flexible links operatively suspending said base plate between said first and second spring means.

13. The device according to claim 1, including a plurality of said electric resistance heating elements and means mounting said elements parallel to the axis of drum and arranged in spaced relation around an arc of the axis spaced from the surface of the drum.

14. A heat generating device comprising in combination a supporting structure, a fixed drum with its axis horizontally supported in said supporting structure, a horizontally located rotor drum, means mounting said rotor drum for rotation within said fixed drum coaxially, relative thereto so as to define, a coaxially located annular space between said fixed drum and said rotor drum, means for introducing viscous fluid between said drums to develop heat from the relative rotation, a surrounding casing, means to mount said device within said casing, said mounting means including a base plate, said device being secured to said base plate, and means to mount said base plate resiliently within said casing including, means to mount said source of power upon said base plate, support means from said base plate on said supporting structure, first spring means on said supports, second spring means on said base plate and flexible links operatively suspending said base plate between said first and second spring means.

15. The device according to claim 14 wherein said first spring means is arranged on the side of the supports remote from said base plate and is coupled to said flexible link by a coupling member passing through the support and wherein the second spring means is mounted on the side of the base plate remote from the supports and wherein the flexible link is coupled to said second spring means by coupling means passing through said base plate.

* * * * *